US006367123B1

(12) United States Patent
Cheal et al.

(10) Patent No.: US 6,367,123 B1
(45) Date of Patent: Apr. 9, 2002

(54) VEHICLE LID HINGE

(75) Inventors: Jonathan Paul Anthony Cheal, Tamworth; Andrew Proffitt, Wolverhampton, both of (GB)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/638,973

(22) Filed: Aug. 15, 2000

Related U.S. Application Data

(63) Continuation of application No. 09/169,152, filed on Oct. 9, 1998, now Pat. No. 6,230,364.

(51) Int. Cl.[7] ..... E05D 15/32; E05F 5/02

(52) U.S. Cl. ..... 16/370; 16/82; 16/289; 16/335

(58) Field of Search ..... 16/370, 335, 280–282, 16/284, 286–290; 296/76; 180/69.2, 69.21; 49/383, 384, 386; 292/DIG. 14, DIG. 23, 60, 63; 312/319.2, 319.4, 323

(56) References Cited

U.S. PATENT DOCUMENTS

| | | | | |
|---|---|---|---|---|
| 769,201 A | * | 9/1904 | Blarcom et al. | 16/85 |
| 1,588,349 A | | 6/1926 | Ftacnik | |

(List continued on next page.)

FOREIGN PATENT DOCUMENTS

| | | | |
|---|---|---|---|
| AT | 376 754 | | 12/1984 |
| DE | 593 478 | | 2/1934 |
| DE | 3840 245 | | 5/1990 |
| DE | 3922932 | * | 1/1991 |
| DE | 197 21 941 | | 5/1997 |
| DE | 296 08 315 | | 9/1997 |
| EP | 0 369 072 | | 5/1990 |
| EP | 0808982 | | 11/1997 |
| FR | 548323 | * | 1/1923 |
| FR | 2621064 | * | 9/1987 |
| GB | 21972 | * | 3/1902 |
| GB | 1 265 296 | | 3/1972 |
| GB | 2 015 641 | | 9/1979 |
| IT | 534065 | * | 10/1955 |
| WO | WO 91/19071 | | 1/1991 |

*Primary Examiner*—Chuck Y. Mah
(74) *Attorney, Agent, or Firm*—Mark W. Croll; Lisa M. Soltis; Paul F. Donovan

(57) ABSTRACT

A hinge and linkage system comprises a four-link system wherein first and second links are respectively connected to vehicle body and closure members, and an additional pair of links interconnect the first and second links. An expansible gas strut also interconnects the first and second links. In accordance with the invention, an expansible spring-biased plunger mechanism is mounted upon one of the additional links so as to operatively engage and be axially compressed by the second link and the closure member when the closure member is disposed at its latched position. When the closure member is unlatched, the spring-biased plunger mechanism initially partially elevates the closure member toward its open position whereupon the expansible gas strut can continue the elevational movement of the closure toward its open position.

40 Claims, 3 Drawing Sheets

U.S. PATENT DOCUMENTS

| | | | | | |
|---|---|---|---|---|---|
| 1,652,643 | A | | 12/1927 | Sherwood | |
| 1,700,086 | A | * | 1/1929 | Shewood | 16/85 |
| 1,816,024 | A | * | 7/1931 | Petersen | 16/82 |
| 2,520,921 | A | | 9/1950 | Foster | |
| 2,656,563 | A | * | 10/1953 | Jones | 16/289 |
| 2,662,681 | A | * | 12/1953 | Stapleton | 16/289 |
| 2,720,676 | A | | 10/1955 | Vigmostad | |
| 3,024,488 | A | | 3/1962 | Germann | |
| 3,195,173 | A | | 7/1965 | McNay et al. | |
| 3,351,975 | A | | 11/1967 | Goto | |
| 3,621,509 | A | | 11/1971 | Bugnell | |
| 4,310,948 | A | * | 1/1982 | Rock et al. | 16/335 |
| 4,383,347 | A | | 5/1983 | La Conte | |
| 4,580,315 | A | | 4/1986 | Beckwith | |
| 4,679,841 | A | | 7/1987 | Taunay | |
| 4,783,881 | A | | 11/1988 | Ho | |
| 4,966,403 | A | | 10/1990 | Nordstrom | |
| 5,008,977 | A | | 4/1991 | Lautenschlager et al. | |
| 5,373,609 | A | | 12/1994 | Ferrari et al. | |
| 5,544,388 | A | | 8/1996 | Chiura | |
| 5,836,050 | A | * | 11/1998 | Rumez et al. | 16/82 |
| 6,021,606 | A | * | 2/2000 | Kos | 16/289 |

* cited by examiner

VEHICLE LID HINGE

This application is a CIP of 09/169,152 filed Oct. 9, 1998, now U.S. Pat. No. 6,230,364.

FIELD OF THE INVENTION

This invention is concerned with a device for assisting the initial opening of a four-link hinge for a vehicle lid and to a four-link hinge for a vehicle lid fitted with such a spring device, and in particular to such a spring device that may be fitted to an assembled four-link hinge without the need for tools.

BACKGROUND TO THE INVENTION

Four-link hinges are often used on the boot lids of European cars because they intrude less into the boot space when the lid is closed, and enable the lid to be opened to a greater angle from its closed position than the more conventional hinge comprising a single curved link. Use of such four-link hinges on car boot lids increases the usable boot space and improves access thereto.

Four-link hinges in general comprise a gas strut connected between two of the links and operable to open the hinge by acting upon said two links. However, it has been found that the line of action of the gas strut is such that it acts to open the hinge only once the hinge is partially opened. This means that the boot lid initially seems to be excessively heavy to a person attempting to open it, and prevents the lid from being opened from inside the car using a remote catch, since the boot lid is held closed by its weight and locks again as soon as the remote catch is released.

Several arrangements have been proposed for opening the hinge to the point where the gas strut starts to act, including, in one arrangement a folded leaf spring attached to a first link and acting upon a second link, and in a second arrangement a cam pivotally attached to one of the links such that the gas Strut initially acts upon the cam rather than the link itself to open the hinge.

Car manufacturers have been slow to accept either arrangement for a number of reasons, but principally because of their appearances, and their tendencies to distort the lid when in the closed position.

SUMMARY OF THE INVENTION

According to a first aspect of the present invention there is provided a device for assisting the initial opening of a hinge for a vehicle lid, comprising an elongate body in which a plunger is slidable, the plunger being engageable with the hinge, and spring means disposed in the body and acting on the plunger to urge it into an extended position.

Thus the invention provides a device for assisting the initial opening of a hinge for a vehicle boot lid that is discrete in appearance and does not cause the hinge to distort the boot lid when in the closed position.

Preferably the plunger engages with the hinge only when the binge is in a closed position and during the initial opening of the hinge from the closed position.

Preferably the plunger is retained by a fastening means attached to the elongate body.

Preferably the elongate body, plunger and annular fastening are formed from rigid plastics material.

The rigid plastics material may advantageously be an acetal resin.

Preferably the spring means is a helical compression spring.

Advantageously the spring means may be damped such that the plunger moves to the extended position at a controlled rate.

Preferably the elongate body has a cylindrical internal cavity having an opening to accommodate the plunger, the plunger being cylindrical and the fastening means being annular.

Preferably the elongate body is formed with an annular recess at the opening of the cylindrical internal cavity In which radially projecting ribs formed on the annular fastening engage.

According to a particularly advantageous feature of the invention the plunger may be formed such that in the extended position it exerts a radial outward force upon the annular fastening and forces the radially projecting ribs into the annular recess to strengthen the attachment of the annular fastening to the elongate body.

According to a second aspect of the invention there is provided a four-link hinge for a vehicle lid comprising a main spring means or gas strut operable against one of the links to urge the hinge into an open position, and a device for assisting the initial opening of the hinge, wherein the device comprises an elongate body in which a plunger is restrained by an annular fastening attached to the elongate body, and spring means for urging the plunger into an extended position for engagement with the hinge.

Preferably the elongate body comprises a flexible angled member which extends from a wall of the elongate body to define a slot between the flexible angled member and said wall, thereby enabling the device to be mounted upon a first link of the hinge such that when the hinge is closed, the plunger acts upon part of the hinge to assist the initial opening thereof.

Typically the hinge is a hinge of a vehicle boot lid but may be, for example, the hinge of a vehicle bonnet.

Preferably the four-link hinge comprises a body link for attaching to a vehicle body, a lid link for attaching to a vehicle lid, short and long links joining the body and lid links, and a gas strut attached between the body and lid links, said device being attached to the long link such that the plunger acts upon the end of the gas strut attached to the lid link.

The long link may advantageously be cranked or kinked to accommodate the device within the hinge without increasing the overall width of the hinge.

Advantageously the elongate body may further comprise a stud which projects into said slot to engage with an aperture in one of the links, such that said flexible angled member may be sufficiently deformed to enable the stud to pass over the thickness of the link until the stud engages with the aperture, thereby securing the device in position upon the link.

BRIEF DESCRIPTION OF THE DRAWINGS

The invention will now be described, by way of example only, with reference to the accompanying drawings in which.

DESCRIPTION

Figure 2:
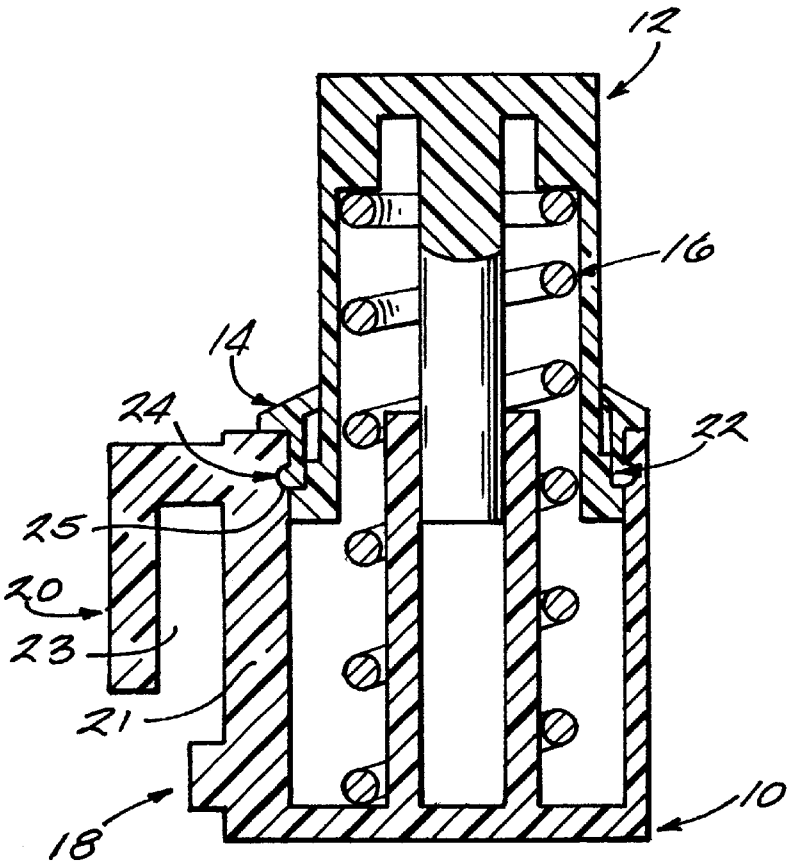
FIG. 2 is a section of the spring device showing the plunger in an extended position.
Figure 1:
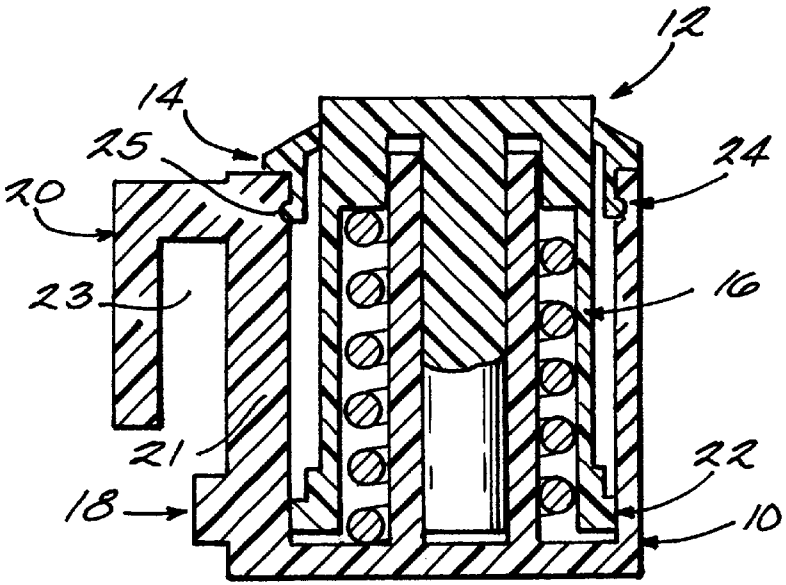
FIG. 1 is a section of a spring device in accordance with the invention, the device being shown with its plunger in a retracted position.

FIGS. 1 and 2 show a spring device having an elongate body 10, a cylindrical plunger 12, an annular fastening 14 and a helical compression spring 16.

In FIG. 1 the plunger 12 is in a retracted position relative to the elongate body 10 due to a load (not shown) acting upon the plunger.

In FIG. 2 the plunger 12 is in all extended position relative to the elongate body 10 in which the extension of the plunger due to the helical compression spring 16 has been arrested by the annular fastening 14.

The elongate body 10, cylindrical plunger 12 and annular fastening 14 are all formed from an acetal resin.

The elongate body 10 is formed with an angled member 20 extending from a wall thereof, defining a slot between the angled member and the wall to enable the spring device to be mounted upon a link of a hinge. A circular stud 18 projects from the wall of the elongate body 10 into the slot.

The annular fastening 14 is formed with a radially outwardly projecting rib 24 that engages with an annular recess formed in the internal wall of the elongate body 10. The cylindrical plunger 12 has a stepped radially projecting ridge 22 at its base. The ridge 22 both ensures that the plunger 12 is restrained by the annular fastening 14 and forces the radially projecting rib 24 thereof into the annular recess formed in the internal wall of the elongate body 10, thus reinforcing the attachment of the annular fastening 12 to the elongate body 10.

Figure 3:
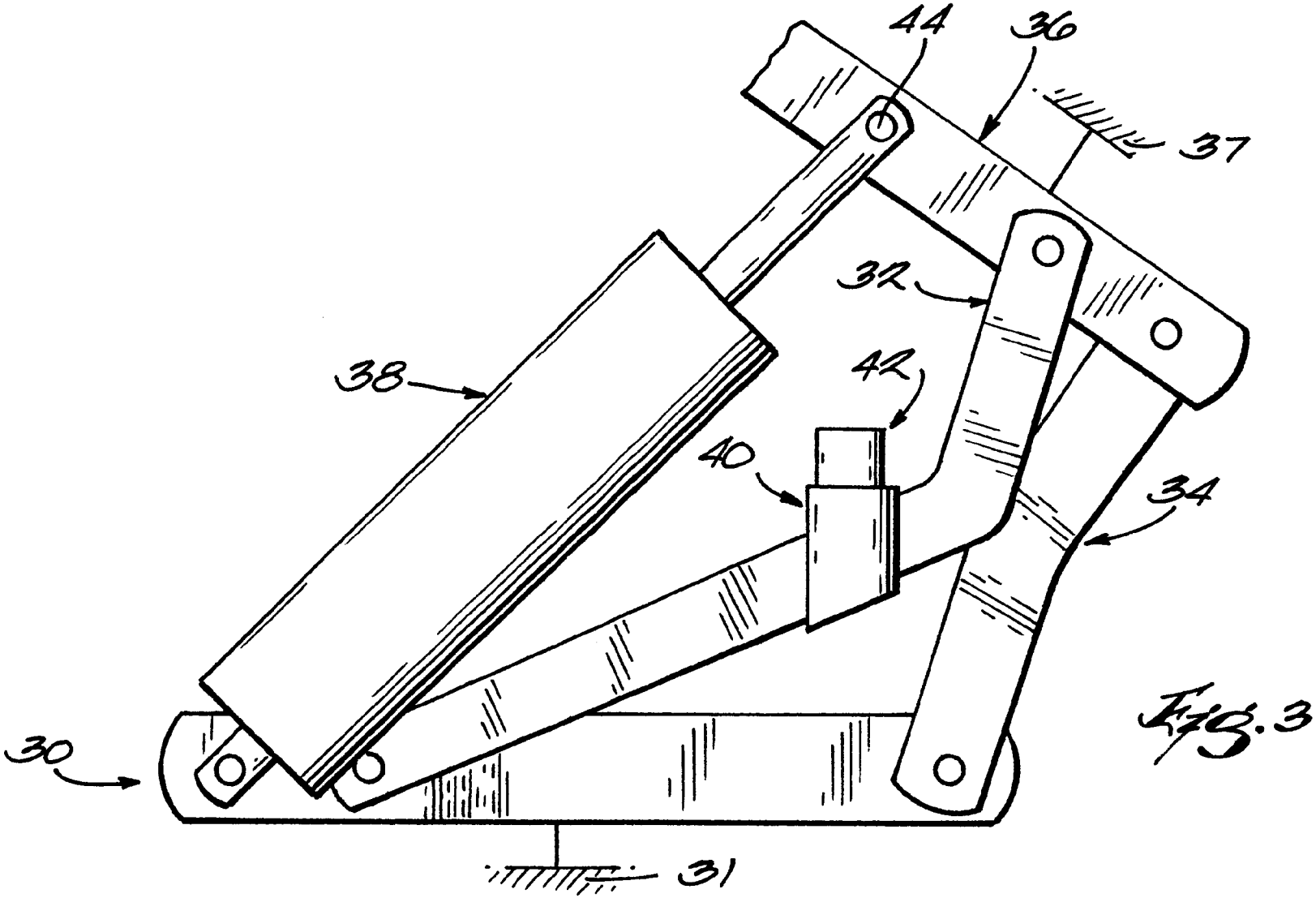
FIG. 3 is a side view of a four-link hinge incorporating the spring device, the hinge being shown in its open position.

FIG. 3 is a side view of a four-link hinge in accordance with the second aspect of the invention, the four-link hinge comprising a body link 30 attachable to the body of a vehicle, a long link 32, a short link 34, a lid link 36 attachable to the vehicle lid, a gas strut 38 and a spring device 40 including a plunger 42.

Figure 4:
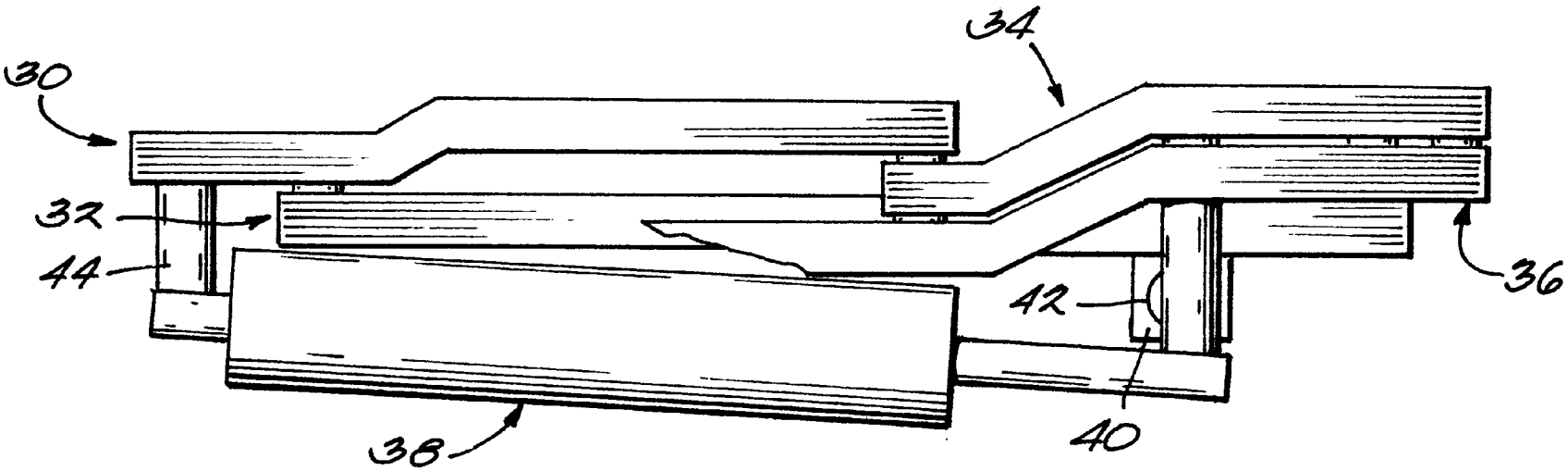
FIG. 4 is a plan view of the four-link hinge when closed.

The construction and operation of the four-link hinge is described with reference to FIGS. 3 and 4.

The long and short links 32 and 34 respectively are attached by pivots at their first ends to the body link 30 and at their second ends to the lid link 36. The gas strut 38 is attached by pivots at its first end to the body link 30 and at its second end to the lid link 36. The spring device 40 is mounted upon the long link 32 such that when the hinge is closed, the plunger 42 of the spring device 40 is depressed by the gas strut pivot 44.

When the four-link hinge is closed the plunger 42 of the spring device 40 acts upon the gas strut pivot 44. The force produced by the compression spring 16 (FIGS. 1 and 2) in the spring device is sufficient to raise the lid when unlocked, and hence open the four-link hinge to a point at which the gas strut is operable to assist the complete opening of the hinge and lid.

What is claimed as new and desired to be protected by Letters Patent to the United States of America, is:

1. A hinge and linkage system for permitting pivotal movement of a latchable closure member with respect to a body member and for assisting the lifting of the closure member with respect to the body member, comprising:

a first hinge part adapted to be attached to the body member;

a second hinge part adapted to be attached to the closure member;

a plurality of linkage members hingedly interconnecting said first hinge part to said second hinge part; and a spring-biased plunger mechanism fixedly mounted upon one of said plurality of linkage members and operatively disengageably engageable with said second hinge part which is adapted to be attached to the latchable closure member such that when the latchable closure member is disposed in its latched position, said first and second hinge parts are disposed in close proximity with respect to each other such that said spring-biased plunger mechanism is operatively engaged with said second hinge part and thereby axially compressed, whereas when the latchable closure member is unlatched, said spring-biased plunger mechanism undergoes axial expansion so as to cause said second hinge part and the closure member to which said second hinge part is attached to undergo partial elevational movement with respect to the body member, whereupon continued elevational movement of the closure member with respect to the body member, said spring-biased plunger mechanism will be operatively disengaged from said second hinge part.

2. The hinge and linkage system as set forth in claim 1, wherein:

said plurality of linkage members comprises a pair of linkage members hingedly interconnecting said first and second hinge parts.

3. The hinge and linkage system as set forth in claim 2, wherein:

said pair of linkage members comprises a relatively long linkage member and a relatively short linkage member.

4. The hinge and linkage system as set forth in claim 3, wherein:

said hinge and linkage system comprises a four-link hinge mechanism defined by said first and second hinge parts, said relatively long linkage member which is hingedly connected to intermediate portions of each one of said first and second hinge parts, and said relatively short linkage member which is hingedly connected to first end portions of said first and second hinge parts.

5. The hinge and linkage system as set forth in claim 4, further comprising:

an expansible strut hingedly connected to second opposite end portions of said first and second hinge parts.

6. The hinge and linkage system as set forth in claim 1, wherein said spring-biased plunger mechanism comprises:

a housing adapted to be fixedly mounted upon said one of said plurality of linkage members;

a spring member disposed within said housing; and a plunger member movably disposed with respect to said housing under the biasing influence of said spring member and adapted to be operatively disengageably engageable with the latchable closure member such that when the latchable closure member is disposed in its latched position, the closure member is disposed in close proximity with respect to the body member such that said spring-biased plunger member is operatively engaged with the closure member and is axially compressed, whereas when the latchable closure member is unlatched, said spring-biased plunger member is initially engaged with the closure member and undergoes axial expansion so as to cause the closure member to initially undergo partial elevational movement with respect to the body member, whereupon continued elevational movement of the closure member with respect to the body member, said spring-biased plunger member will be operatively disengaged from the closure member.

7. The hinge and linkage system as set forth in claim 6, further comprising:

an expansible strut hingedly connected to said first and second hinge parts for achieving said continued elevational movement of the closure member subsequent to the initial partial elevational movement of the closure member by said spring-biased plunger member.

8. The hinge and linkage system as set forth in claim 7, wherein:

said expansible strut comprises a gas strut.

9. The hinge and linkage system as set forth in claim 6, wherein:

said housing has a bracket member integral therewith for mounting said spring-biased plunger mechanism upon said one of said plurality of linkage members.

10. The hinge and linkage system as set forth in claim 6, wherein:

said housing has a cap member snap-fitted thereon for preventing separation of said spring-biased plunger member from said housing.

11. The hinge and linkage system as set forth in claim 10, wherein:

said housing has an annular recess defined within an interior side wall portion thereof; and said cap member is provided with an annular rib which is adapted to be snap-fitted within said annular recess defined within said housing interior side wall portion.

12. The hinge and linkage system as set forth in claim 11, wherein:

said spring-biased plunger member has a stepped-configuration for engaging said housing cap member and for maintaining said annular rib member of said cap member disposed within said annular recess defined within said side wall of said housing.

13. A hinge and linkage system for permitting pivotal movement of a latchable closure member with respect to a body member and for assisting the lifting of the closure member with respect to the body member, comprising:

a first hinge part adapted to be attached to the body member;

a second hinge part adapted to be attached to the closure member;

a plurality of linkage members hingedly interconnecting said first hinge part to said second hinge part;

an expansible strut hingedly interconnected to said first hinge part and to said second hinge part; and a spring-biased plunger mechanism fixedly mounted upon one of said plurality of linkage members and operatively disengageably engageable with said second hinge part which is adapted to be attached to the latchable closure member such that when the latchable closure member is disposed in its latched position, said first and second hinge parts are disposed in close proximity with respect to each other such that said spring-biased plunger mechanism is operatively engaged with said second hinge part and is axially compressed, whereas when the latchable closure member is unlatched, said spring-biased plunger mechanism undergoes axial expansion so as to cause said second hinge part and the closure member to undergo partial elevational movement with respect to the body member, whereupon continued elevational movement of the closure member with respect to the body member by said expansible strut, said spring-biased plunger mechanism will be operatively disengaged from said second hinge part.

14. The hinge and linkage system as set forth in claim 13, wherein:

said plurality of linkage members comprises a pair of linkage members hingedly interconnecting said first and second hinge parts.

15. The hinge and linkage system as set forth in claim 14, wherein:

said pair of linkage members comprises a relatively long linkage member and a relatively short linkage member.

16. The hinge and linkage system as set forth in claim 15, wherein:

said hinge and linkage system comprises a four-link hinge mechanism defined by said first and second hinge parts, said relatively long linkage member which is hingedly connected to intermediate portions of each one of said first and second hinge parts, and said relatively short linkage member which is hingedly connected to first end portions of said first and second hinge parts.

17. The hinge and linkage system as set forth in claim 16, wherein:

said expansible strut is hingedly connected to second opposite end portions of said first and second hinge parts.

18. The hinge and linkage system as set forth in claim 13, wherein:

said expansible strut comprises a gas strut.

19. The hinge and linkage system as set forth in claim 13, wherein said spring-biased plunger mechanism comprises:

a housing adapted to be fixedly mounted upon said one of said plurality of linkage members;

a spring member disposed within said housing; and a plunger member movably disposed with respect to said housing under the biasing influence of said spring member and adapted to be operatively disengageably engageable with the latchable closure member such that when the latchable closure member is disposed in its latched position, the closure member is disposed in close proximity with respect to the body member such that said spring-biased plunger member is operatively engaged with the closure member and is axially compressed, whereas when the latchable closure member is unlatched, said spring-biased plunger member is initially engaged with the closure member and undergoes axial expansion so as to cause the closure member to initially undergo partial elevational movement with respect to the body member, whereupon continued elevational movement of the closure member with respect to the body member by said expansible strut, said spring-biased plunger member will be operatively disengaged from the closure member.

20. The hinge and linkage system as set forth in claim 19, wherein:

said housing has a bracket member integral therewith for mounting said spring-biased plunger mechanism upon said one of said plurality of linkage members.

21. The hinge and linkage system as set forth in claim 19, wherein:

said housing has a cap member snap-fitted thereon for preventing separation of said spring-biased plunger member from said housing.

22. The hinge and linkage system as set forth in claim 21, wherein:

said housing has an annular recess defined within an interior side wall portion thereof; and said cap member is provided with an annular rib which is adapted to be snap-fitted within said annular recess defined within said housing interior side wall portion.

23. The hinge and linkage system as set forth in claim 22, wherein:

said spring-biased plunger member has a stepped-configuration for engaging said housing cap member and for maintaining said annular rib member of said cap member disposed within said annular recess defined within said side wall of said housing.

24. In combination, a hinge and linkage system for permitting pivotal movement of a latchable closure member with respect to a body member and for assisting the lifting of said closure member with respect to said body member, comprising:

a body member;

a closure member;

a first hinge part attached to said body member;

a second hinge part attached to said closure member;

a plurality of linkage members hingedly interconnecting said first hinge part to said second hinge part;

an expansible strut hingedly interconnected to said first hinge part and to said second hinge part; and a spring-biased plunger mechanism fixedly mounted upon one of said plurality of linkage members and operatively disengageably engageable with said second hinge part which is attached to said latchable closure member such that when said latchable closure member is disposed in its latched position, said first and second hinge parts are disposed in close proximity with respect to each other such that said spring-biased plunger mechanism is operatively engaged with said second hinge part and is axially compressed, whereas when said latchable closure member is unlatched, said spring-biased plunger mechanism undergoes axial expansion so as to cause said second hinge part and said closure member to undergo partial elevational movement with respect to said body member, whereupon continued elevational movement of said closure member with respect to said body member by said expansible strut, said spring-biased plunger mechanism will be operatively disengaged from said second hinge part.

25. The combination as set forth in claim 24, wherein:

said body member comprises an automotive vehicle body; and said closure member comprises an automotive vehicle trunk lid.

26. The combination as set forth in claim 24, wherein:

said plurality of linkage members comprises a pair of linkage members hingedly interconnecting said first and second hinge parts.

27. The combination as set forth in claim 26, wherein:

said pair of linkage members comprises a relatively long linkage member and a relatively short linkage member.

28. The combination as set forth in claim 27, wherein:

said hinge and linkage system comprises a four-link hinge mechanism defined by said first and second hinge parts, said relatively long linkage member which is hingedly connected to intermediate portions of each one of said first and second hinge parts, and said relatively short linkage member which is hingedly connected to first end portions of said first and second hinge parts.

29. The combination as set forth in claim 28, wherein:

said expansible strut is hingedly connected to second opposite end portions of said first and second hinge parts.

30. The combination as set forth in claim 24, wherein:

said expansible strut comprises a gas strut.

31. The combination as set forth in claim 24, wherein said spring-biased plunger mechanism comprises:

a housing adapted to be fixedly mounted upon said one of said plurality of linkage members;

a spring member disposed within said housing; and a plunger member movably disposed with respect to said housing under the biasing influence of said spring member and adapted to be operatively disengageably engageable with the latchable closure member such that when the latchable closure member is disposed in its latched position, the closure member is disposed in close proximity with respect to the body member such that said spring-biased plunger member is operatively engaged with the closure member and is axially compressed, whereas when the latchable closure member is unlatched, said spring-biased plunger member is initially engaged with the closure member and undergoes axial expansion so as to cause the closure member to initially undergo partial elevational movement with respect to the body member, whereupon continued elevational movement of the closure member with respect to the body member by said expansible strut, said spring-biased plunger member will be operatively disengaged from the closure member.

32. The combination as set forth in claim 31, wherein:

said housing has a bracket member integral therewith for mounting said spring-biased plunger mechanism upon said one of said plurality of linkage members.

33. The combination as set forth in claim 31, wherein:

said housing has a cap member snap-fitted thereon for preventing separation of said spring-biased plunger member from said housing.

34. The combination as set forth in claim 33, wherein:

said housing has an annular recess defined within an interior side wall portion thereof; and said cap member is provided with an annular rib which is adapted to be snap-fitted within said annular recess defined within said housing interior side wall portion.

35. The combination as set forth in claim 34, wherein:

said spring-biased plunger member has a stepped-configuration for engaging said housing cap member and for maintaining said annular rib member of said cap member disposed within said annular recess defined within said side wall of said housing.

36. A spring-biased plunger mechanism for use in connection with a hinge and linkage system, for permitting pivotal movement of a latchable closure member with respect to a body member, and for assisting the lifting of the closure member with respect to the body member, comprising:

a housing adapted to be fixedly mounted upon a linkage member of the linkage system;

a spring member disposed within said housing; and a plunger member movably disposed with respect to said housing under the biasing influence of said spring member and adapted to be operatively disengageably engageable with the latchable closure member such that when the latchable closure member is disposed in its latched position, the closure member is disposed in close proximity with respect to the body member such that said spring-biased plunger member is operatively engaged with the closure member and is axially compressed, whereas when the latchable closure member is unlatched, said spring-biased plunger member is initially engaged with the closure member and undergoes axial expansion so as to cause the closure member to undergo partial elevational movement with respect to the body member, whereupon continued elevational movement of the closure member with respect to the body member, said spring-biased plunger member will be operatively disengaged from the closure member.

37. The spring-biased plunger mechanism as set forth in claim 36, wherein:

said housing has a bracket member integral therewith for mounting said spring-biased plunger mechanism upon said one of said plurality of linkage members.

38. The spring-biased plunger mechanism as set forth in claim 36, wherein:

said housing has a cap member snap-fitted thereon for preventing separation of said spring-biased plunger member from said housing.

39. The spring-biased plunger mechanism as set forth in claim 38, wherein:

said housing has an annular recess defined within an interior side wall portion thereof; and said cap member is provided with an annular rib which is adapted to be snap-fitted within said annular recess defined within said housing interior side wall portion.

40. The spring-biased plunger mechanism as set forth in claim 39, wherein:

said spring-biased plunger member has a stepped-configuration for engaging said housing cap member and thereby maintaining said annular rib member of said cap member disposed within said annular recess defined within said side wall of said housing.

* * * * *